US009821942B1

(12) United States Patent
Kaye

(10) Patent No.: US 9,821,942 B1
(45) Date of Patent: Nov. 21, 2017

(54) FLASHLIGHT DISPLAY PACKAGE

(71) Applicant: LB Marketing Inc., Alpharetta, GA (US)

(72) Inventor: Douglas Kaye, Alpharetta, GA (US)

( * ) Notice: Subject to any disclaimer, the term of this patent is extended or adjusted under 35 U.S.C. 154(b) by 0 days.

(21) Appl. No.: 15/177,530

(22) Filed: Jun. 9, 2016

Related U.S. Application Data

(60) Provisional application No. 62/182,576, filed on Jun. 21, 2015.

(51) Int. Cl.

| | |
|---|---|
| ***B65D 75/36*** | (2006.01) |
| ***F21L 4/00*** | (2006.01) |
| ***F21V 23/04*** | (2006.01) |
| ***F21V 21/40*** | (2006.01) |
| ***B65B 5/04*** | (2006.01) |
| ***B65B 5/02*** | (2006.01) |
| ***B65D 73/00*** | (2006.01) |
| ***B65D 75/56*** | (2006.01) |
| ***B65D 85/00*** | (2006.01) |

(52) U.S. Cl.
CPC ..... *B65D 75/36* (2013.01); *B65B 5/02* (2013.01); *B65B 5/04* (2013.01); *B65D 73/0042* (2013.01); *B65D 75/566* (2013.01); *B65D 85/70* (2013.01); *F21L 4/005* (2013.01); *F21V 21/406* (2013.01); *F21V 23/0421* (2013.01)

(58) Field of Classification Search
CPC .. B65D 5/5023; B65D 5/528; B65D 73/0085; B65D 73/0092; B65D 2201/00; A45F 5/10
USPC ..... 206/316.1–316.3, 5, 461–471, 495; 229/117.14; 53/48.9; 220/737
See application file for complete search history.

(56) References Cited

U.S. PATENT DOCUMENTS

| | | | | |
|---|---|---|---|---|
| 1,910,168 | A | 5/1933 | Jacobs | |
| 2,983,368 | A | 5/1961 | Lugt, Jr. | |
| 4,046,251 | A | 9/1977 | Bruml | |
| 4,171,050 | A | 10/1979 | Murray et al. | |
| 4,702,374 | A * | 10/1987 | Kelner | B65D 75/36 206/418 |
| 4,804,984 | A * | 2/1989 | Heuer | B65D 75/32 206/316.2 |
| 4,848,577 | A * | 7/1989 | Hoffman | B65D 5/5026 206/467 |
| 5,048,677 | A * | 9/1991 | Pedracine | B65D 5/52 206/349 |
| 6,742,911 | B1 * | 6/2004 | Chen | F21V 23/0421 200/313 |
| 7,392,906 | B2 * | 7/2008 | Yu | B65D 75/36 206/471 |
| 7,549,654 | B2 | 6/2009 | Anderson et al. | |
| 7,621,405 | B2 * | 11/2009 | Schweitzer | B65D 73/0092 206/463 |

(Continued)

*Primary Examiner* — J. Gregory Pickett
*Assistant Examiner* — Brijesh V. Patel
(74) *Attorney, Agent, or Firm* — Lawrence J. Shurupoff

(57) ABSTRACT

A retail display card holds a product such as a flashlight in a tilted or skewed orientation with respect to the general plane of the top and bottom surfaces of the display card. In this manner, substantially the entire front lens of the flashlight is held above the plane of the card and substantially the entire rear on-off switch of the flashlight is held below the plane of the card. This allows a potential purchaser to easily access the on-off switch and view a substantially unobstructed beam of light produced by the flashlight.

19 Claims, 9 Drawing Sheets

(56) References Cited

U.S. PATENT DOCUMENTS

| | | | | |
|---|---|---|---|---|
| 8,505,727 | B2 | 8/2013 | Dalton et al. | |
| 8,800,768 | B2 * | 8/2014 | Corbat | B65D 75/322 206/463 |
| 2006/0076927 | A1 * | 4/2006 | Nottingham | B65D 75/32 320/114 |
| 2007/0125672 | A1 * | 6/2007 | Epling | B65D 75/32 206/316.1 |
| 2012/0085676 | A1 * | 4/2012 | Pedersen | B65D 75/366 206/525 |

* cited by examiner

FLASHLIGHT DISPLAY PACKAGE

BACKGROUND AND SUMMARY

Consumer retail products are often packaged in form fitting display packaging referred to as "blister" packaging. This packaging typically includes a clear plastic sheet encapsulating a product so that a consumer can visually inspect the contents of the package. Some blister packaging can be formed as a planar display card adapted to hang from a wire on a display rack.

While conventional display cards function adequately for many consumer products, some consumer products, such as battery powered products, have special packaging needs. For example, those products sold with installed batteries can leave a consumer guessing as to whether the installed batteries are fully charged or "fresh" or whether the useful or "shelf" life of the installed batteries has expired.

A particular packaging challenge arises in the case of retail display packaging for flashlights. That is, consumers not only like to test the condition of the batteries installed in a flashlight, they also like to examine the shape, color and intensity of the beam of light produced by the flashlight. Add to this the retailer's need to prevent consumers from removing the flashlight and any accompanying products (such as extra batteries) from the packaging, and a difficult packaging design challenge results.

When further considering the needs of a retail packaging design, the need to present an interesting eye-catching package design arises. In the case of a retail package for a flashlight, it is also desirable to allow virtually unobstructed access to the on-off switch to facilitate testing by a potential customer. This easy access can serve as an invitation to a customer to try out the flashlight.

In order for a potential customer to obtain a clear view of the light beam produced by a flashlight prior to purchase, it is desirable to avoid any blockage of the light beam due to the presence of any opaque packaging material obstructing the light beam. This adds yet another challenge to the packaging design.

In those cases where a flashlight is provided with a textured or specially contoured portion such as a grooved or checkered central hand grip, it is advantageous to allow for direct tactile access by a consumer. This is particularly the case where the grip portion may be coated or covered with an elastomeric grip sleeve. An open readily accessible grip portion on the flashlight packaging offers further incentive to a potential customer to touch, grip and squeeze the flashlight and test its operation.

While the consumer is invited to try out a flashlight with the packaging features noted above, any additional packaging design feature which attracts the interest of the consumer is beneficial to the retailer. That is, if a package can display a product in an eye-catching configuration, the likelihood of consumer interest and the potential purchase of a product is increased.

The packaging described in detail below has been designed to satisfy the packaging requirements noted above with a clear plastic blister package constructed with a unique manufacturing process for retail packaging of flashlights as well as other retail consumer products.

BRIEF DESCRIPTION OF THE DRAWINGS

In the drawings.

In the various views of the drawings, like reference numerals designate like or similar parts.

DETAILED DESCRIPTION OF REPRESENTATIVE EMBODIMENTS

Figure 1:
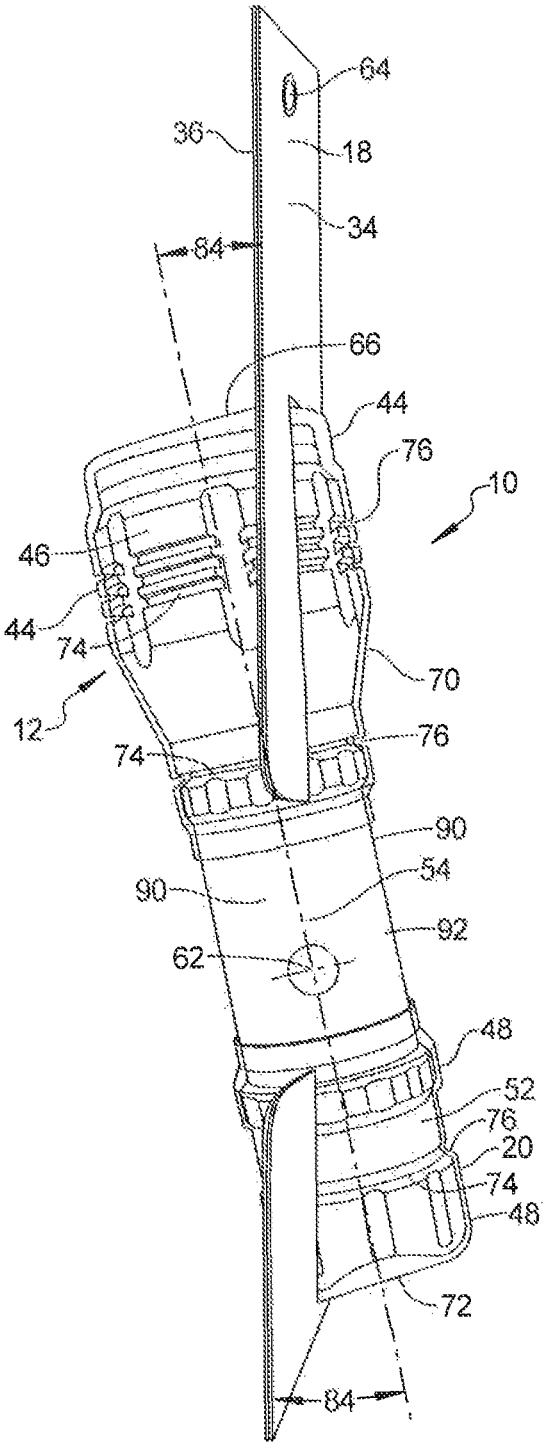
FIG. 1 is a bottom side perspective view of a flashlight display package constructed in accordance with one exemplary embodiment of this disclosure.

The following description is merely exemplary in nature and is not intended to limit the disclosure in any way.

As shown in FIGS. 1 through 5, a flashlight display package 10 is constructed for use as a retail display card in the sale of consumer products. The package 10 in this representative embodiment is adapted for displaying consumer products, and particularly elongated consumer products displayed in an eye-catching manner. While the package 10 is shown displaying a flashlight 12, other products may also be displayed in the package 10, such as batteries, cell phones, and other electrical and mechanical products. In the representative embodiments described herein, the flashlight 12 preferably includes at least one internal battery arranged in a conventional fashion to power the flashlight and enable a potential customer to easily operate and evaluate the operation of the flashlight prior to purchase.

The package 10 includes a card 18 formed of one or more layers of sheet material such as paper, cardboard, metal foil or plastic. As described more fully below, the flashlight 12 is held on the card 18 with a plastic shell or "blister" 20 formed of two molded half-shells, as described below. The plastic shell 20 can be formed to match and complement the shape and surface contours of the flashlight 12. In this example, the shell 20 is formed of two clear transparent plastic sheets coupled together along confronting planar portions such as by ultrasonic welding, heat or adhesive bonding. Mechanical fasteners such as staples may also be used for this purpose.

In order to hold the flashlight 12 in a substantially fixed predetermined position within the shell 20, a keyed alignment of the flashlight 12 with the card 18 is provided by one or more complementary keyed structures. As shown in the drawings, grooves, ridges, projections and/or recesses on the outer surfaces of the flashlight 12 can engage mating complementary grooves, ridges, projections and/or recesses formed on the inner surfaces of the shell 20.

Figure 2:
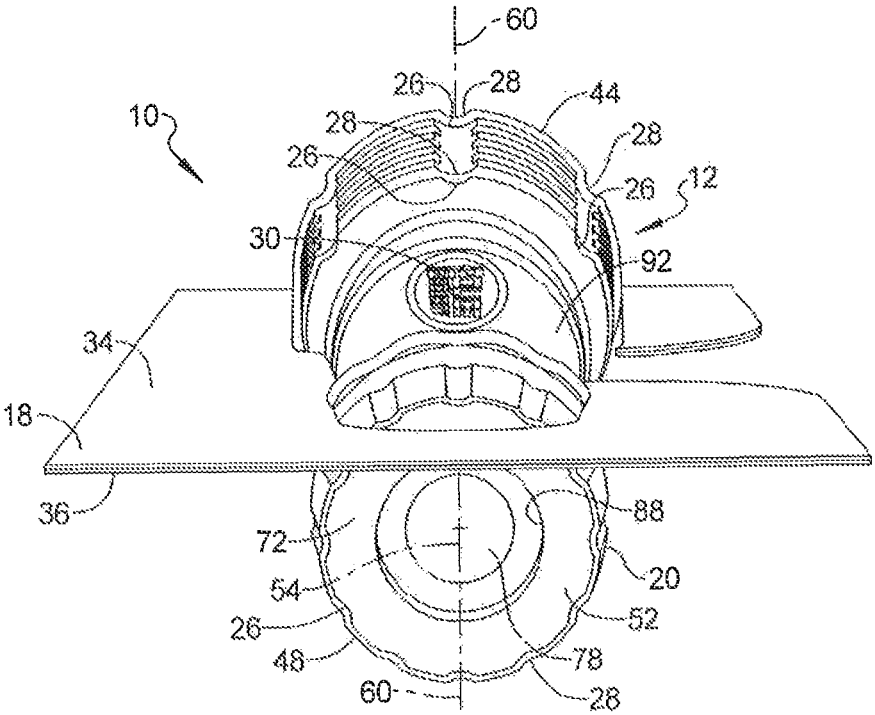
FIG. 2 is a rear top perspective view of FIG. 1.

For example, as seen in FIG. 2, rotation of the flashlight 12 on the card 18 can be limited or prevented by axially-extending grooves 26 formed on the outer surface of the flashlight 12. Grooves 26 can receive and interengage with axially-extending and radially-inwardly projecting complementary protrusions 28 formed on the inner surface of the shell 20 to align and lock the flashlight 12 in a desired predetermined position within the shell 20. In this manner, product information provided on the outer surface of the flashlight 12 such as trademarks and other marketing information 30 (FIG. 2) can be presented to a consumer in a desirable, easily visible, clearly readable, unobstructed and predetermined orientation with respect to the shell 20 and card 18. Preferably, the information 30 is centered on the top central portion of the flashlight midway between the adjoining portions of the card 18, such as seen in FIG. 2.

Figure 3:
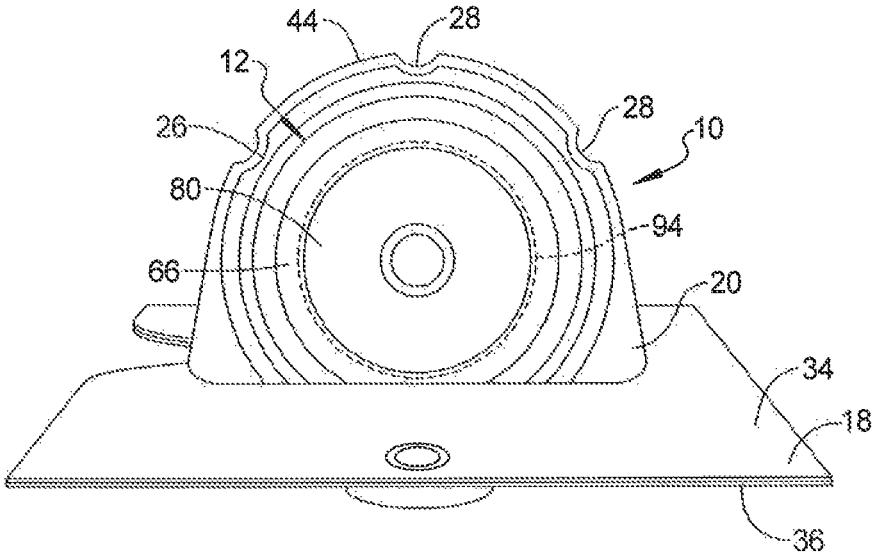
FIG. 3 is a front top perspective view of FIG. 1.
Figure 4:
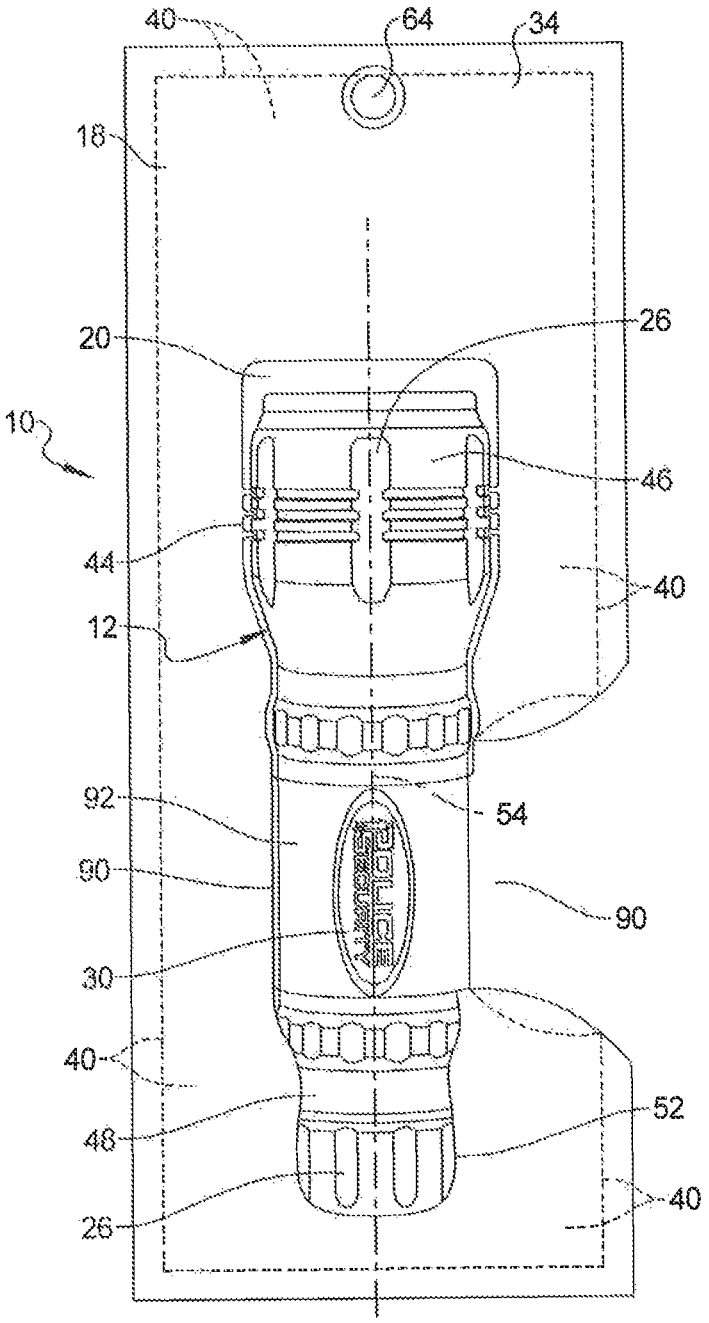
FIG. 4 is a top plan view of FIG. 1.
Figure 5:
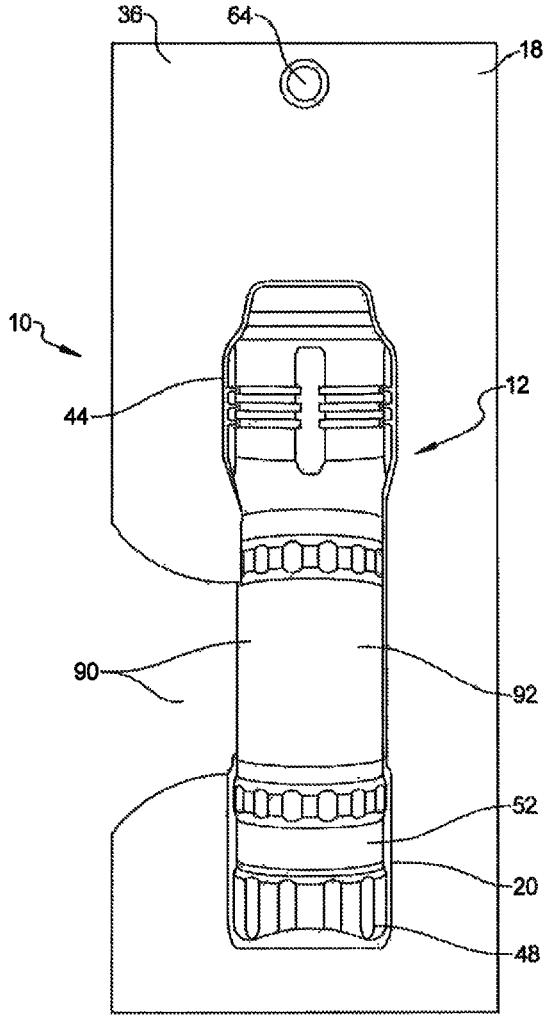
FIG. 5 is bottom plan view of FIG. 1.

As further seen in FIGS. 1 through 5, the card 18 has a first or top surface portion 34 and a second or bottom surface portion 36. In this example, the top and bottom surface portions are substantially parallel planar surfaces. However, other surface profiles can be employed such as wavy or stepped surfaces. In this embodiment, the shell 20, as shown in dashed lines in FIG. 4, is formed with planar lateral border portions 40 laminated between the top and bottom planar surface portions 34, 36 of the card 18. The terms top and bottom, upper and lower and front and rear are used herein merely as reference positions and are not intended to be limiting as these positions may be reversed consistently throughout in accordance with this disclosure.

The border portions 40 extend laterally from and interconnect first and second tubular sleeve portions 44, 48 on the shell 20 and serve as anchor portions for anchoring and axially spacing the sleeves on the card 18 in a fixed position. The first sleeve 44 is carried on a front or first portion of the card 18 and the second sleeve 48 is carried on a rear or second portion of the card.

The top and bottom surfaces 34, 36 of the card 18 can be arranged as separate top and bottom sheets of material coupled over the top and bottom surfaces of the planar border portions 40 of the shell 20. Alternatively, the border portions 40 can be simply placed over the top surface 36 of the card 18 and coupled to it using any conventional method.

The clear transparent plastic shell 20 is formed with at least one sleeve 44 or 48 for positioning and holding at least one portion of the flashlight 12 within the sleeve and to hold and orient the flashlight on the card 18. In this example, the first or front sleeve 44 retains a first or front portion 46 of the flashlight 12 on the card 18 and a second or rear sleeve 48 retains a second or rear portion 52 of the flashlight 12 on the card 18. Each sleeve 44, 48 resists or prevents rotation of the flashlight 12 as described above, and further limits or prevents axial or longitudinal movement of the flashlight on the package 10.

As further seen in FIGS. 1 and 4, each sleeve 44, 48 is substantially centered around and axially spaced apart along a common longitudinal axis 54. The shell 20 is designed so that the longitudinal axis 54 of one or both sleeves 44, 48 is substantially parallel and coaxial with the central longitudinal axis 60 (FIG.2) of the flashlight 12. The front and rear portions 46, 52 of the flashlight 12 are axially spaced apart along the longitudinal axis 60. Moreover, the center of gravity 62 (FIG. 1) of the flashlight 12 is positioned on the card 18 so that the center of gravity 62 lies within the plane of the card 18 or within several millimeters up to several centimeters, e.g. two centimeters, from the substantially common plane of the planar surfaces 34, 36 of the card 18.

This alignment of the center of gravity 62 of the flashlight 12 with the plane of the planar surfaces 34, 36 of the card 18 acts as a plumb to hold the card 18 in vertical alignment when the package 10 is hanging on a display rack. For example, the card 18 is shown formed with a central mounting portion such as a through hole 64 for hanging the package 10 on a wire arm on a retail display rack. It is desirable to present the package 10 in a vertical position so that a consumer can easily see and read the entire front surface of the card and visually inspect the contours and surfaces on the flashlight 12.

As noted above, axial movement of the flashlight 12 within the shell 20 is prevented or restricted by one or more of the sleeves 44, 48. As shown in FIGS. 1 and 3, the first or front sleeve 44 has a clear substantially planar radial end wall 66 preventing forward movement of the flashlight 12 and a frustoconical collar 70 preventing or limiting rearward movement of the flashlight 12. Rearward movement is further limited, restrained or prevented by a partial annular radial end wall 72 on the second or rear sleeve 48.

Axial movement of the flashlight 12 can be further limited by keyed interengagement between one or more radial grooves 74 formed on the front portion 46 of the flashlight 12 and one of more radially-inwardly extending protrusions or ridge portions 76 formed on the front sleeve 44. The ridge portions 76 can extend at least partially into the grooves 74 with a complementary keyed fit. In one embodiment, the grooves 74 and ridge portions 76 can be formed as annular grooves and ridges.

Similar complementary keyed grooves 74 and ridge portions 76 can be respectively provided on the second or rear portion 52 of the flashlight 12 and on the second or rear sleeve 48. Of course, the keying structures between the flashlight 12 and the sleeves 44, 48 in all examples can be reversed with the protrusions or ridges formed on the flashlight 12 such that grooves formed in the sleeves receive the protrusions or ridges on the flashlight.

Tilting the flashlight 12 on the card 18 provides easy access to and direct contact with an on-off switch 78 (FIG. 2) on the rear end or tailcap of the flashlight 12 and elimination or minimization of any obstruction to the beam of light shining through the substantially planar radially-extending front lens 80 (FIG. 3) of the flashlight 12. That is, the longitudinal axis 60 of the flashlight 12 is aligned or oriented at an acute angle 84 (FIG. 1) with respect to the substantially flat plane of the card 18. This is achieved by aligning the axis 54 of both sleeves 44, 48 of the shell 20 at about the same acute angle 84 with the plane of the card 18.

If only one sleeve is used, then the longitudinal axis of that sleeve is oriented at a similar acute angle 84. Angle 84 can vary from product to product and can range from about four degrees up to about forty-five degrees or even more. A suitable range for most flashlights is about four degrees to about thirty degrees, and preferably about four degrees to about fifteen degrees. A particularly suitable range for angle 84 is about four to about eight degrees.

As seen in FIG. 2, an access opening 88 is cut or otherwise formed in the radial end wall 72 of the second or rear sleeve 48 to allow substantially unobstructed free access to and operation of the on-off switch 78. Switch 78 is positioned and held substantially or completely below the second or bottom surface 36 of the card 18 due to the "tilt" or inclination of the sleeves 44, 48 with respect to the planar surface of the card 18. If a card 18 has a wavy or irregular profile, the sleeves 44, 48 can still be inclined or tilted in a similar manner to the general surface profile of the card.

At least over fifty percent of the area of the radial end face of the on-off switch should extend below the bottom surface 36 of the card 18. An optional opening 94 can be provided in the front end wall 66 as shown in dashed lines in FIG. 3.

The opening 94 can eliminate any distortion or other effects caused by the shell 20 on the flashlight light beam as it passes through the shell.

As further seen in FIG. 3, the circular radial lens 80 of the flashlight 12 is held completely above the first or top surface 34 of the card 18 so that the light beam from the flashlight is substantially or completely unobstructed or blocked by the card 18. In effect, the flashlight 12 is skewed or titled with respect to the plane of card 18 so that one end portion of the flashlight 12 lies mostly above the card, a central or mid portion of the flashlight passes through the plane of the card 18 and the opposite end portion of the flashlight 12 lies mostly below the plane of the card 18. At least over fifty percent of the area of the lens 80 should extend above the top surface 34 of the card 18.

This titled or slanted configuration of the sleeves 44, 48 on the shell 20 results in a major portion of the surface area of the first or front sleeve 44 extending above the first or top surface 34 of card 18 and a minor portion of the surface area of the front sleeve 44 extending below the second or bottom surface 36 of the card 18. Likewise, a major portion of the second or rear sleeve 48 extends below the second or bottom surface 36 and a minor portion of the sleeve 18 extends above the first or top surface 34. This unusual orientation and presentation of the flashlight can result in an eye-catching display package 10 inviting a retail consumer to try out and evaluate the operation of the flashlight 12.

Additional "hands on" or direct access to the flashlight 12 is provided by forming a cut on access area in the card 18 and the shell 20. For example, as shown in FIGS. 1, 2 and 3, an opening, recess or cut out access area 90 extending along a central portion of the flashlight 12 provides an access opening to a grip portion 92 of the flashlight 12. This grip portion 92, located between the front and rear portions 46, 54 of the flashlight 12, is typically held by a user when operating the flashlight.

A method of assembling the package 10 around the flashlight 12 is shown in FIGS. 6 through 9. To begin, upper and lower production mold forms can be produced using an actual flashlight 12 as an initial mold form. The flashlight 12 is oriented in a predetermined position when forming the permanent molds. In this manner, the upper and lower production mold forms will produce upper and lower halves of shell 20 with the same contours and forms as the outer surface of the flashlight 12 and in the same predetermined orientation. For example, the half molds can be oriented so as to position product information 30 on the flashlight 12 at a top or twelve o'clock position centered between opposite side edges of the shell 20 to facilitate visibility of the product information.

Figure 6:
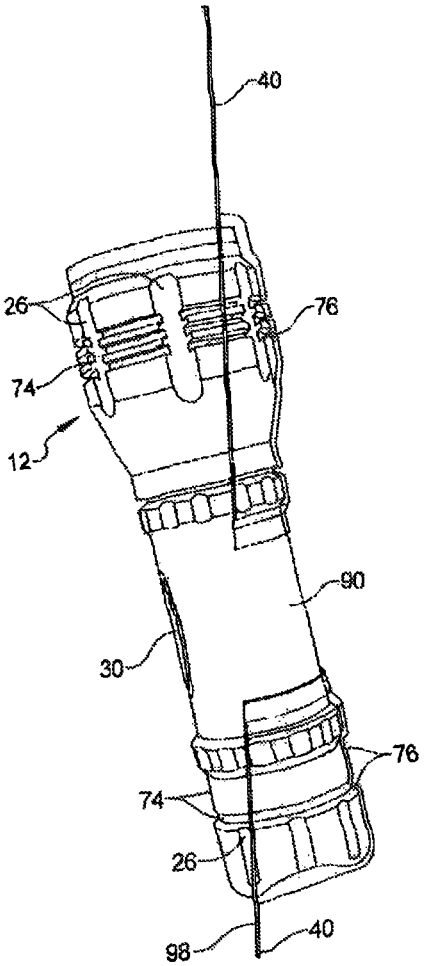
FIG. 6 is a side view of an initial assembly step in producing the display package of FIG. 1 showing a flashlight positioned in a clear plastic blister bottom half shell.
Figure 7:
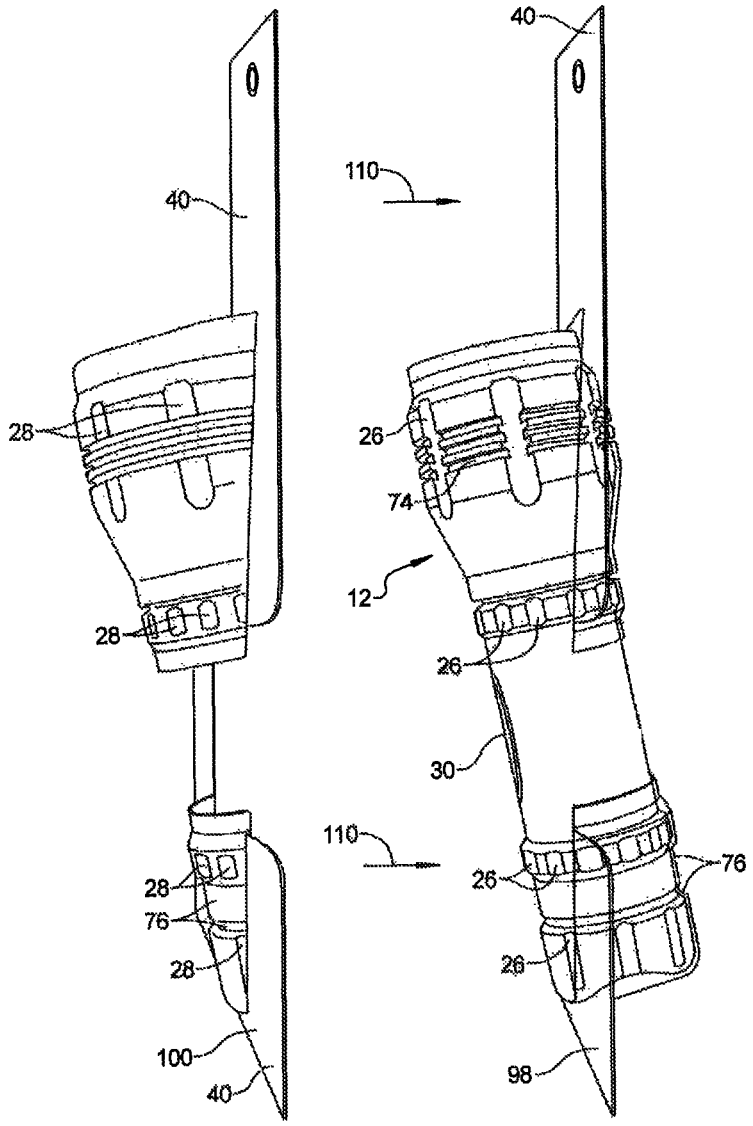
FIG. 7 is a top side perspective view of a secondary assembly step in producing the display package of FIG. 1 showing a clear plastic blister top half shell aligned for placement over the subassembly of FIG. 6.

Sheets of clear transparent plastic can be individually or simultaneously vacuum molded over these production forms to produce upper and lower shell halves in a known conventional vacuum molding process. As seen in FIGS. 6 and 7, a flashlight 12 is placed in a first complementary lower half shell 98 in a preferred orientation with trademark and product marketing information 30 centered and facing upwardly.

FIG. 7 shows details of the protrusions 28, 76 formed on each half shell 98, 100. Also shown are the corresponding complementary matching grooves 26, 74 formed on the flashlight 12. As further shown in FIG. 7, the subassembly of FIG. 6 is fitted with a second complementary half shell 100 by moving the half shell 100 onto half shell 98 along directional arrows 110. The resulting full shell 20 is shown completely encapsulating the flashlight 12 in FIG. 8.

Figure 8:
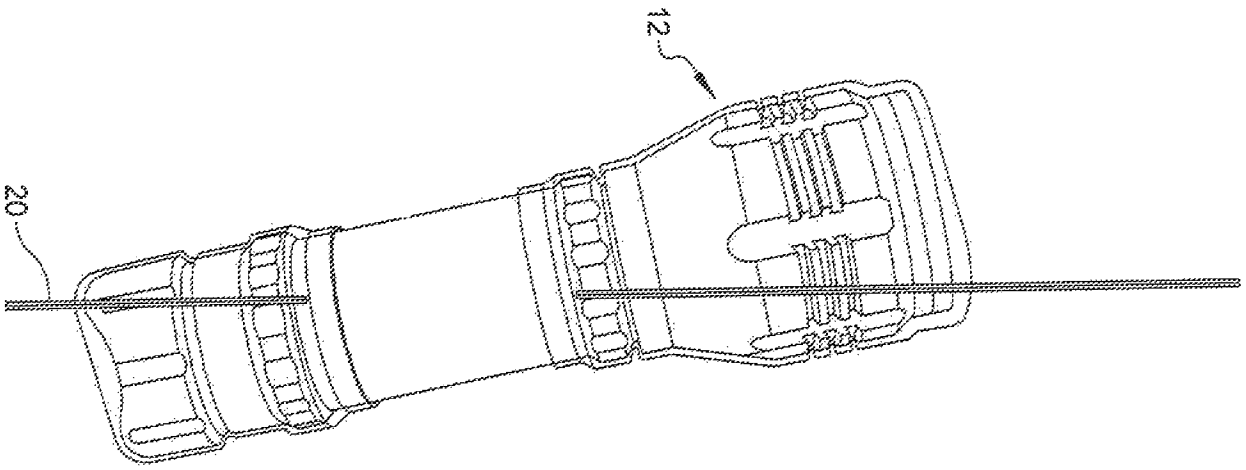
FIG. 8 is a side view of a flashlight held within the plastic shell assembled as shown in FIG. 7.
Figure 9:
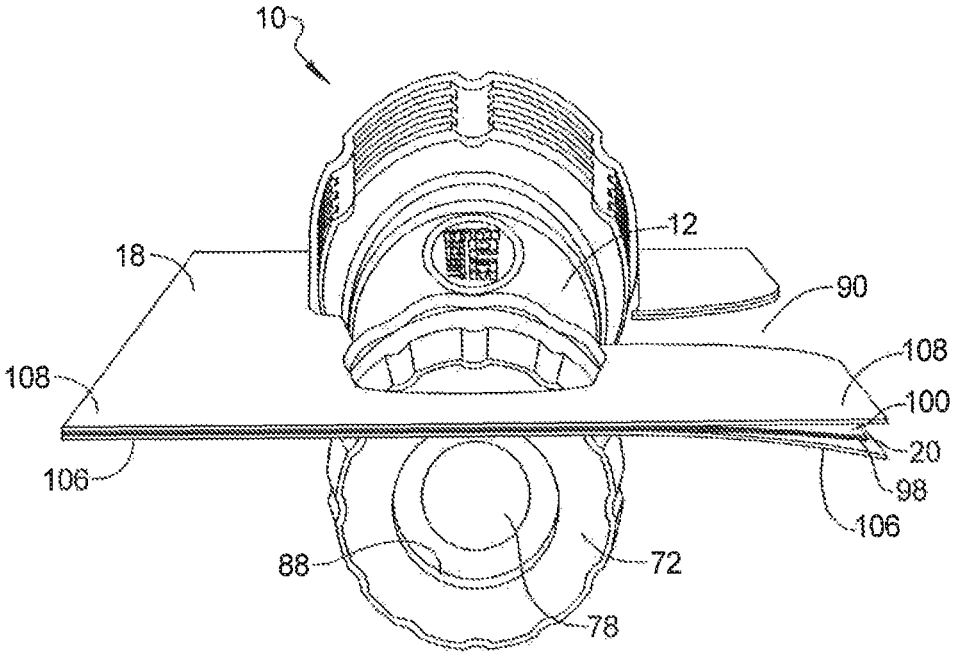
FIG. 9 is a top rear view of a finished flashlight display package as shown in FIG. 1 with top and bottom card layers laminated over the subassembly of FIG. 8 with the display card layers partially peeled apart for clarity.

FIG. 9 shows a four layered laminated card 18 with upper and lower card layers 108, 106 laminated over the subassembly of FIG. 8. Layers 108 and 106 can be formed of paper cardboard or other material on which printing and graphic information may be displayed. Prior to lamination of the shell 20 within the card layers 108, 106, the shell 20 can be preformed with an open access area 90 or later cut out to remove material from the open access area 90 and from around the grip portion 92. FIG. 9 shows the removal of plastic material from the second or rear end wall 72 to form an opening 88 far exposing the on-off switch 78 to provide easy access by a persons thumb or finger to operate the on-off switch.

FIG. 9 further shows a completed package 10 holding a flashlight 12. The shell 20 is shown placed between the upper card layer 108 and the lower card layer 106 which are heat bonded or otherwise coupled to each respective upper and lower half shell 98, 100. The upper and lower card layers 108 and 106 are peeled apart adjacent the rear border of the open access area 90 to show the laminated structure of the card 18.

It will be appreciated by those skilled in the art that the above flashlight display package is merely representative of the many possible embodiments of the disclosure and that the scope of the disclosure should not be limited thereto. Those skilled in the art can now appreciate from the foregoing description that the teachings of the disclosure can be implemented in a variety of forms. While the disclosure includes particular examples, the scope of the disclosure should not be so limited since other modifications will become apparent to the skilled practitioner upon a study of the drawings, the specification and the following claims.

What is claimed is:

1. A flashlight display package, comprising:

a card having a top surface portion and a bottom surface portion;

a plastic shell laminated with said card and comprising a first tubular plastic sleeve carried on a first portion of said shell and a second tubular plastic sleeve carried on a second portion of said shell;

a flashlight having a longitudinal axis and having a front portion held above said top surface portion of said card in said first tubular plastic sleeve and having a rear portion held below said bottom surface portion of said card in said second tubular plastic sleeve, said front and rear portions of said flashlight and said first and second tubular plastic sleeves axially spaced apart along said longitudinal axis;

said flashlight comprising a grip portion located between said front and rear portions of said flashlight and between said first and second tubular plastic sleeves; an open direct tactile access area in said card and in said shell between said front and rear portions of said flashlight and between said first and second tubular plastic sleeves allowing hands on direct access to said grip portion and allowing a consumer to feel said grip portion with said flashlight held in said first and second tubular plastic sleeves;

at least one battery provided in said flashlight and powering said flashlight to shine; and said longitudinal axis of said flashlight extending at an acute angle with respect to said top and bottom surface portions of card.

2. The package of claim 1, wherein said flashlight comprises a radial front lens portion and wherein at least a majority of said radial front lens portion extends above said top surface portion of said card enabling a beam of light from said flashlight to shine substantially without obstruction from said card.

3. The package of claim 1, wherein said rear portion of said flashlight comprises an on-off switch having a radially-extending end portion, and wherein said second tubular plastic sleeve is formed with an opening adjacent said on-off switch allowing contact' with said radially-extending end portion and allowing actuation of said on-off switch through said opening.

4. The package of claim 3, wherein at least a majority of said on-off switch extends below said bottom surface portion of said card enabling access to said radially-extending end portion of said on-off switch substantially without obstruction from said card.

5. The package of claim 1 wherein said first and second tubular plastic sleeves are formed from two sheets of clear transparent plastic coupled together and wherein said first and second tubular plastic sleeves are interconnected by first and second planar portions of said two sheets of clear transparent plastic.

6. The package of claim 1, wherein said front portion of said flashlight comprises one or more radial grooves and wherein said first tubular plastic sleeve extends into said one or more radial grooves so as to limit movement of said front portion of said flashlight on said card.

7. The package of claim 6, wherein said one or more radial grooves comprises an annular groove and wherein said first tubular plastic sleeve extends into said front annular groove.

8. The package of claim 6, wherein said one or more radial grooves comprises a front axially-extending groove and wherein said first plastic sleeve extends into said front axially-extending groove.

9. The package of claim 1, further comprising keying structure between said flashlight and said shell limiting movement of said flashlight on said card.

10. The package of claim 9, wherein said keying structures comprise an annular groove and an annular protrusion extending into said annular groove.

11. The package of claim 9, wherein said keying structures comprise an axially-extending groove and an axially-extending protrusion.

12. The package of claim 1, wherein said open direct tactile access area extends inwardly from an outer edge portion of said card toward said flashlight.

13. The package of claim 1, wherein said top and bottom surface portions of said card comprise substantially planar surface portions of said card.

14. The package of claim 1, wherein said top surface portion of said card comprises a planar surface portion extending in a plane, wherein said flashlight comprises a center of gravity, and wherein said center of gravity is located within two centimeters of said plane.

15. The package of claim 1, wherein said card further comprises a mounting portion for hanging said package on a display rack, and wherein said flashlight comprises a center of gravity positioned with respect to said card such that said card hangs in a substantially vertical orientation when hanging on a display rack.

16. The package of claim 1, wherein said flashlight comprises product information visibly displayed on an outer top surface portion of said flashlight and wherein said first and second tubular sleeves hold said flashlight in a predetermined orientation on said card such that said product information is located above said card and is clearly and easily readable without visual obstruction from said card.

17. The package of claim 1, wherein said acute angle comprises an angle within the range of about four degrees to about fifteen degrees.

18. A flashlight display package, comprising:

a substantially planar card extending in a plane and having a top surface layer and a bottom surface layer;

a plastic shell laminated with said card and comprising a tubular plastic sleeve comprising first and second sheets of transparent plastic laminated between said top and bottom surface layers of said substantially planar card, said tubular plastic sleeve comprising a central longitudinal sleeve axis;

a flashlight comprising a central longitudinal flashlight axis, said flashlight being axially and radially restrained within said tubular plastic sleeve and held on said substantially planar card by said tubular plastic sleeve;

axially-extending complementary keyed structures provided between said flashlight and said shell and comprising an axially-extending groove provided on one of said flashlight and said shell and an axially-extending protrusion provided on the other one of said flashlight and said shell, wherein said keyed structure limits rotation of said flashlight within said shell;

at least one battery provided in said flashlight and powering said flashlight to shine; and said sleeve axis and said flashlight axis aligned substantially parallel with each other and said sleeve axis and said flashlight axis extending at an acute angle of between about four degrees to about thirty degrees with respect to said plane of said substantially planar card.

19. The package of claim 18, wherein said flashlight further comprises a radially-extending front lens comprising a radial front lens area, and a rear on-off switch comprising a radially-extending rear on-off switch area, and wherein over fifty percent of said radial front lens area extends above said top surface portion of said substantially planar card and wherein over fifty percent of said radial rear on-off switch area extends below said bottom surface portion of said substantially planar card, such that light emitted from said flashlight is substantially unobstructed by said substantially planar card, and access to operate said on-off switch is substantially unobstructed by said substantially planar card.

* * * * *